United States Patent [19]

Bowles

[11] 4,369,352

[45] Jan. 18, 1983

[54] TEMPERATURE CONTROL SYSTEM FACILITATING COOKING TEMPERATURE CALIBRATION IN SELF-CLEANING OVEN

[75] Inventor: Howard R. Bowles, Louisville, Ky.

[73] Assignee: General Electric Company, Louisville, Ky.

[21] Appl. No.: 220,867

[22] Filed: Dec. 29, 1980

[51] Int. Cl.[3] ..... H05B 1/02

[52] U.S. Cl. ..... 219/413; 219/494; 219/395; 219/398; 219/396; 374/1

[58] Field of Search ..... 219/490, 494, 491, 492, 219/493, 413, 412, 396–398, 395; 73/1 F

[56] References Cited

U.S. PATENT DOCUMENTS

| | | | |
|---|---|---|---|
| 3,121,158 | 2/1964 | Hurko | 219/397 |
| 3,569,670 | 3/1971 | Eff | 219/397 |
| 3,738,174 | 6/1973 | Waldron | 73/1 F |
| 3,924,101 | 12/1975 | Beard | 219/494 |

FOREIGN PATENT DOCUMENTS

| | | | |
|---|---|---|---|
| 1443184 | 7/1976 | United Kingdom | 219/398 |

*Primary Examiner*—M. H. Paschall

*Attorney, Agent, or Firm*—H. Neil Houser; Radford M. Reams

[57] ABSTRACT

A temperature control system for an electronically-controlled thermal cooking oven having a single oven temperature sensor, which system facilitates varying the calibration set point in the field for normal cooking modes, without affecting the self-cleaning temperature calibration which is factory preset. A sensor-developed analog voltage is employed to control self cleaning temperature in the oven, with the oven temperature during normal cooking modes, such as bake and broil, controlled by the same voltage modified by an independently developed offset value or signal. The required summing of the sensor voltage and the offset voltage preferably is done by means of a suitably-programmed microprocessor-based control system. With this arrangement, the offset can be changed to vary the set point for normal cooking modes without affecting the self-cleaning temperature which is detected solely by the sensor, and cannot be readily varied by field adjustment. Further, the field temperature calibration procedure is simplified due to a predictable discrete adjustment which eliminates cumbersome trial and error procedures.

8 Claims, 5 Drawing Figures

TEMPERATURE CONTROL SYSTEM FACILITATING COOKING TEMPERATURE CALIBRATION IN SELF-CLEANING OVEN

BACKGROUND OF THE INVENTION

The present invention relates to cooking temperature calibration for electronically-controlled thermal ovens also having pyrolitic self-cleaning capability.

It is well known that cooking ovens require some means for adjusting temperature calibration, particularly through the normal range of cooking temperatures, approximately 150° F. to 550° F. Such calibration capability is required for a number of reasons, including manufacturing tolerances, variability of oven liner form factors and heater wattages in different ovens, and field service due to customer preference.

Pyrolitic self-cleaning ovens operating in accordance with the principles disclosed in the Hurko U.S. Pat. No. 3,121,158 additionally periodically operate at a much higher temperature, for example 880° F., during self-cleaning operation. This particular temperature is factory-calibrated and preset, and normally is not changed in the field. Field change of self-cleaning temperatures is undesirable primarily as a result of safety considerations, but additionally from present regulatory agency requirements.

Recently, various forms of electronically-controlled thermal ovens have been developed, for example utilizing microprocessor-based control systems and triac switching elements to control the required oven functions.

In order to provide temperature feedback for both a relatively lower range of normal cooking temperatures as well as at the relatively higher temperature for pyrolitic self-cleaning, electronically-controlled ovens typically include a single oven-temperature sensor, such as a thermistor, having a known resistance-temperature characteristic. In particular, the temperature sensor for electronic controls is placed in series with a precision voltage divider resistor, and the pair then connected between a fixed DC voltage and a system analog ground. Variation in the sensor resistance due to temperature changes in the oven therefore causes the tap point voltage between the sensor and the voltage divider resistor to vary. This tap point voltage is proportional to oven temperature, and is used by the controller. In an electronically-controlled oven, this voltage is typically converted to digital form by means of a conventional analog-to-digital converter.

An adjustable resistor in series with the sensor could be used to offset the sensor output for calibration purposes. However, not only would this affect calibration through the normal range of cooking temperatures, but it would affect the self-cleaning temperatures as well, an undesirable result.

In any oven temperature adjustable calibration system, an important consideration is ease of adjustment. Particularly for field adjustment procedures, it is desired that adjustments be made as quickly as possible, without involving a cumbersome procedure. For example, a simple set-screw or adjustable potentiometer adjustment may be tedious to use in the field because such arrangements generally do not provide feedback or indication of the amount of adjustment. For example, the field service technician may desire to raise the oven temperature by 25° F., but then has no certain way, absent trial and error, of knowing precisely how much adjustment is required. On thermal ovens which utilize electromechanical temperature controls (hydraulic thermostats or similar devices), one method for adjustment has been to offset the knob which indicates the set point from the calibrated position to a slightly different position. However, on electronic controls which have no knobs, this technique of offsetting the knob set point is impossible.

SUMMARY OF THE INVENTION

It is an object of the invention to provide a temperature control system for an electronically-controlled thermal cooking oven having a single oven temperature sensor, which system facilitates varying the calibration set point in the field for normal cooking modes, without affecting the self-cleaning temperature calibration which is factory preset.

Briefly stated, and in accordance with an overall concept of the invention, a sensor-developed analog voltage is employed to control self cleaning temperature in the oven, with the oven temperature during normal cooking modes, such as bake and broil, controlled by the same voltage modified by an independently developed offset value or signal. The required summing of the sensor voltage and the offset voltage preferably is done by means of a suitably-programmed microprocessor-based control system. With this arrangement, the offset can be changed to vary the set point for normal cooking modes without affecting the self-cleaning temperature which is detected solely by the sensor, and cannot be readily varied by field adjustment.

It is a further overall concept of the invention that the offset value is developed in discrete, definable steps. As a result, a desired offset for calibration purposes can be introduced without requiring subsequent testing or measurement to determine the precise effect of the calibration adjustment.

Briefly stated, and in accordance with a more particular aspect of the invention, an oven has a heating element for heating an oven enclosure, and is operable in two modes respectively corresponding to two different temperature ranges, such as a relatively lower range of normal cooking temperatures and a temperature range including a relatively higher pyrolytic self-cleaning temperature. The oven has a temperature sensor within the oven enclosure operable in both temperature ranges to provide a sensor output signal. There is additionally the improvement of a calibration input device for selectively establishing one of a plurality of discrete temperature offset values; and a controller which operates during one of the modes to energize the heating element as a function of both the temperature sensor output signal and the established temperature offset value, and which operates during the other of the modes to energize the heating element as a function of the temperature sensor output signal, but not of the offset value; whereby temperature calibration for one of the temperature ranges corresponding to said one of the modes is facilitated without affecting temperature calibration for the other of the temperature ranges corresponding to said other of the modes.

Briefly stated and in accordance with a still more particular aspect of the invention, in combination with a thermal food cooking oven including a heating element and selectively operable either in a normal cooking mode or a pyrolitic self-cleaning mode, there is provided a temperature control system including a single temperature sensor within the oven enclosure for providing a temperature sensor output signal both through a relatively lower range of normal cooking temperatures and at a relatively higher pyrolitic self-cleaning temperature. The temperature control system facilitates temperature calibration for the relatively lower range of normal cooking temperature without affecting temperature calibration at the relatively higher pyrolitic self-cleaning temperature, and includes a calibration input device for providing a signal selectively corresponding to one of a plurality of discrete temperature offset values. This calibration input device may comprise, for example, a plurality of series-connected resistors with an interruptable wire link shunting each of the resistors or other arrangement of wire links arranged in a weighted sequence. A user input device, such as a keyboard and an associated digital display, is provided for setting a desired temperature within the relatively lower range of cooking temperatures and providing a desired temperature signal.

The temperature control system additionally includes a controller responsive to the sensor output signal, the offset value signal and the desired temperature signal. The controller is operable during the pyrolitic self-cleaning mode to energize the heating element as required to achieve and maintain a pyrolitic self-cleaning temperature, for example 880° F., within the oven enclosure by comparing sensor output with a fixed preset temperature value, determined at the factory, and energizing the heating element when, for example, the sensor output is less than the fixed preset value. The controller is operable during the normal cooking mode to energize the heating element as required to achieve and maintain the user-desired temperature within the oven enclosure by comparing sensor output with the desired temperature signal, and also taking into account the offset value, and energizing the heating element when sensor output is, for example, less than the desired temperature signal, with the offset value taken into account. Thus, changes in the calibration input device affect only the temperature during the normal cooking mode.

The controller may take the offset value into account during the normal cooking mode by generating the sum of the sensor output signal and the offset value signal, and then comparing the sum with the desired temperature signal. It will be appreciated, however, that the same result may be obtained by summing the offset value with the desired temperature signal, and then comparing the sum with the sensor temperature. In either case, the offset value may indicate either a positive or a negative correction.

BRIEF DESCRIPTION OF THE DRAWINGS

While the novel features of the invention are set forth with particularity in the appended claims, the invention, both as to organization and content, will be better understood and appreciated, from the following detailed description taken in conjunction with the drawings, in which:

DESCRIPTION OF THE PREFERRED EMBODIMENTS

Figure 1:
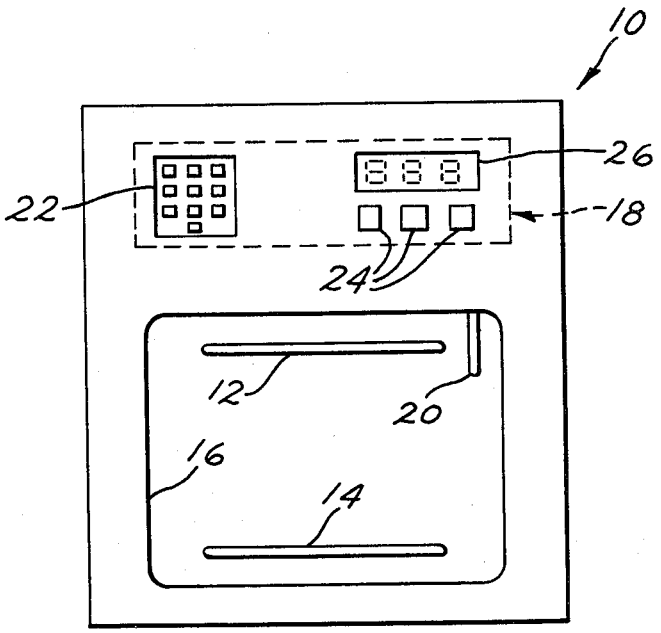
FIG. 1 is a highly schematic front elevational view of a thermal food cooking oven including a temperature control system in accordance with the invention.

Referring first to FIG. 1, a thermal food cooking oven 10 includes conventional electric heating elements shown as a broil element 12 and a bake element 14 within an oven enclosure 16. The oven 10 is operable either in a normal cooking mode, for example through a relatively lower range of normal cooking temperatures in the order of 150° F. to 550° F., as well as in a pyrolitic self-cleaning mode at a temperature of, for example 880° F., as is disclosed in the above-referenced Hurko U.S. Pat. No. 3,121,158.

The oven 10 includes a temperature control system, generally designated 18, including a single electric temperature sensor 20 within the oven enclosure 16. The sensor 20 provides a temperature sensor output signal, which, in general, is employed in conventional fashion as a temperature feedback signal in order that the controller 18 may energize the heating elements 12 and 14 as required to establish and maintain a particular temperature within the oven enclosure 16. The sensor 20 may be any device which generates an electric output signal as a function of temperature, but preferably comprises a temperature dependent resistance device such as a thermistor.

The single sensor 20 provides a temperature sensor output signal as feedback both through the relatively lower range of normal cooking temperatures, as well as at the relatively higher pyrolitic self-cleaning temperature.

In accordance with the invention, the temperature control system 18 facilitates temperature calibration for the relatively lower of normal cooking temperature without affecting temperature calibration at the relatively higher pyrolitic self-cleaning temperature, which is factory preset.

Additional elements shown in FIG. 1 are a data entry keyboard 22, a set 24 of mode input controls, and a digital display device 26, all operating in generally conventional fashion to enable user selection of various oven modes. In particular, the data entry keyboard 22 may be utilized for entering a specific oven temperature for normal cooking, with the selected temperature shown on the digital display device 26.

Figure 2:
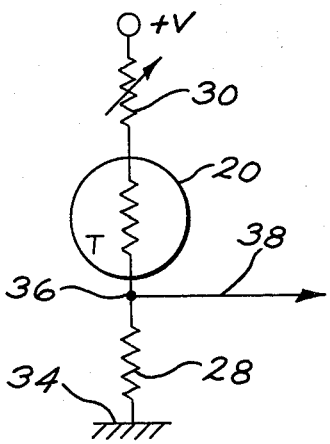
FIG. 2 (PRIOR ART)
FIG. 2 is an electrical schematic diagram of a prior art temperature sensor circuit.

In FIG. 2, a typical prior art approach to providing an adjustable temperature sensor circuit is shown. In particular, the temperature sensor 20, shown as a thermistor, is connected in a series voltage divider arrangement also comprising a precision voltage divider resistor 28, and a variable adjustment resistor 30, connected between a fixed reference voltage source terminal +V and a system analog ground terminal 34. Output from a voltage divider tap point 36 along a line 38 represents sensed temperature, and may be applied to a suitable controller as a temperature feedback signal.

With this particular arrangement of FIG. 2, two particular drawbacks occur: First, if adjustment of the variable resistor 30 is used for calibrating normal cooking temperatures, the temperature for self-cleaning operation is undesirably affected as well. Second, a variable resistor such as the variable resistor 30 does not readily provide feedback or indication of the amount of adjustment, and thus requires a time-consuming trial and error adjustment procedure.

Figure 3:
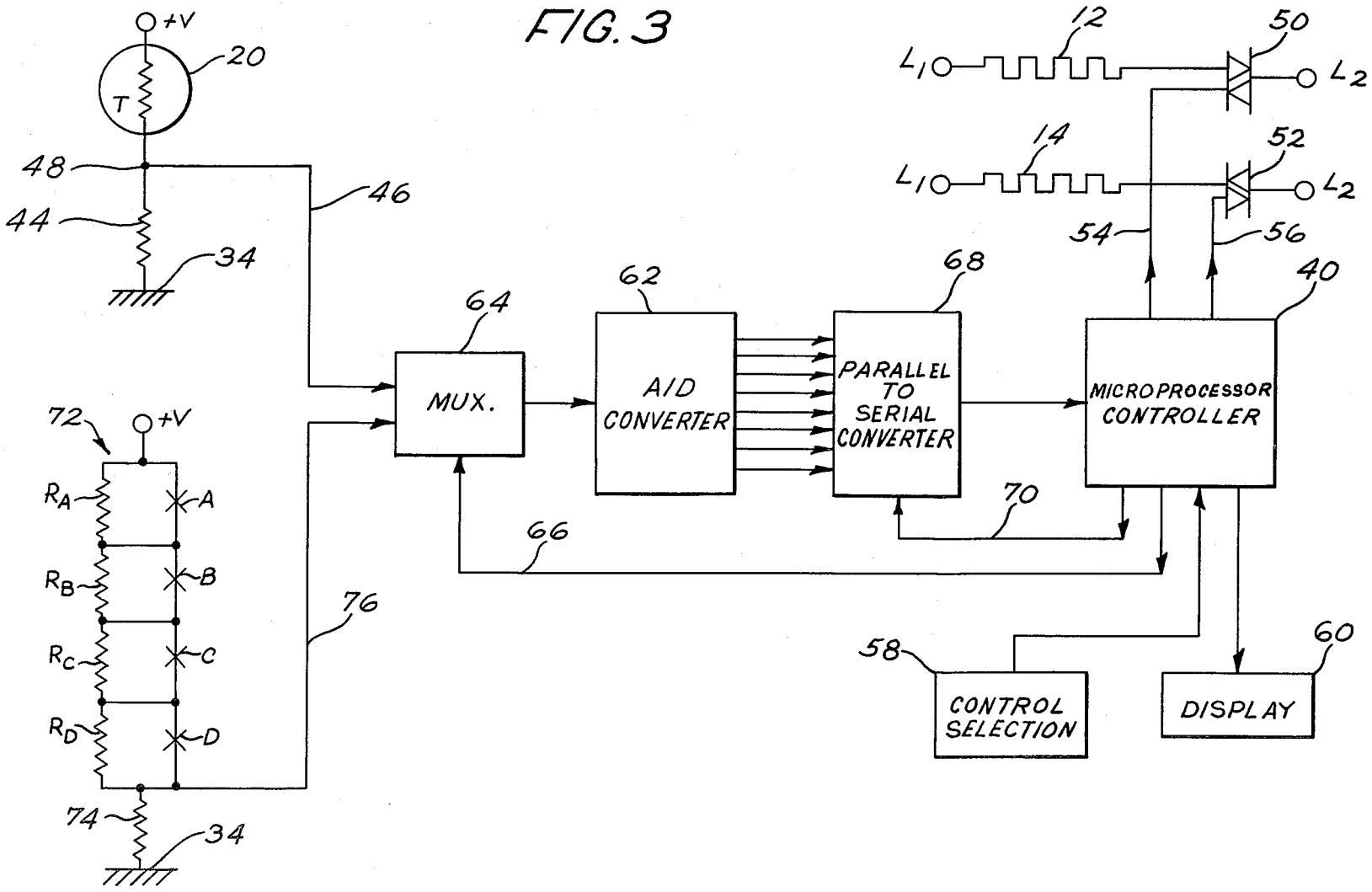
FIG. 3 is an electrical schematic diagram, partly in block diagram form, of an overall system in accordance with the invention.

These considerations are addressed in accordance with the invention as depicted in FIG. 3. The overall system of FIG. 3 includes a microprocessor-based controller 40 including a suitable processing unit, a memory, and a program stored in a portion of the memory. The details of such controllers are now well-known in the art. Since the present invention is not directed to the precise arrangement of the microprocessor-based control system 40 per se, the details are not set forth herein. It will be appreciated that the microprocessor-based controller 40 is not dedicated exclusively to the present control system, but rather controls the overall operation of the oven 10, including surface heating units (not shown) in the event the oven 10 comprises a complete electric range. As is known, with a microprocessor-based control system, additional control features and functions can often be added with little or no increase in hardware cost. The present invention falls in this category, and requires only minimal hardware. The necessary programming is well within the capability of those skilled in the art, although a generalized flowchart example is provided in FIG. 5 herein. One suitable microprocessor which may be included within the microprocessor-based controller 40 is a National Semiconductor Corporation COPS 420.

In FIG. 3, the temperature sensor 20 is included in a voltage divider in series with a precision voltage divider resistor 44 connected between the fixed voltage terminal +V and system analog ground 34. An output line 46 connected to the voltage divider tap point 48 provides a sensor output voltage representative of oven enclosure 16 temperature, as sensed by the sensor 20.

The heating elements 12 and 14 are shown connected in series with respective switching devices, such as triacs 50 and 52 between terminals $L_1$ and $L_2$ to which 240 Volt, 60 Hz AC power is typically applied. In known fashion, the controller 40, through output ports connected to output lines 54 and 56, controls gating or triggering of the triacs 50 and 52, and thus energization of the heating elements 12 and 14.

The controller 40 is user directed by means of various inputs, collectively designated control selection 58, which include mode as well as temperature selections generally corresponding to FIG. 1 elements 22 and 24. The controller 40 provides a display output 60 to the user, generally corresponding to the FIG. 1 digital display 26. The details of the control selection 58 and the display 60 do not particularly concern the present invention, and are therefore not described in detail herein.

As the controller 40 is a digital device, and the sensor 20 output on the line 46 is analog, an analog-to-digital converter 62 is provided, the input of which is selectively connected through a multiplexer 64 to the line 46. The multiplexer 64 is controlled by the controller 40 via a line 66. The analog-to-digital converter 62 may provide its output in the form of eight parallel bits (for 256 steps of resolution), applied to a parallel-to-serial converter 68, which in turn may be connected to a serial input port of the microprocessor-based controller 40. The parallel-to-serial converter 68 is controlled by the controller 40 via a line 70. It is of course possible to utilize a controller 40 programmed to accept a parallel input directly for the converter 62, in which case the parallel-to-serial converter 68 may be omitted.

In accordance with the invention there is provided a calibration input device, generally designated 72, for providing a signal selectively corresponding to one of a plurality of discrete temperature offset values for the purpose of calibrating temperature during normal cooking mode operation. The offset value selected does not in any way affect the pyrolytic self-clean temperature calibration, which is factory preset and preferably not field-adjustable.

More particularly, the calibration input device 72 comprises a plurality of series-connected resistors $R_A$, $R_B$, $R_C$ and $R_D$ of different resistance values connected in series with a precision voltage divider resistor 74 between the fixed voltage +V and the system analog ground 34. Shunting the resitors $R_A$ through $R_D$ are corresponding wire links A, B, C and D, allowing discrete adjustments, in accordance with a predetermined code.

In this particular embodiment, the calibration input device 72 is in the form of a discretely adjustable voltage divider, having an output line 76. Depending upon which of the wire links A, B, C and D are broken, the voltage on the output line 76 has one of a plurality of predictable voltages. Preferably the wire links A, B, C and D comprise cuttable or clipable straps or the like, although it will be appreciated that a wide variety of equivalent arrangements may be employed. At higher cost, an actual switch may even be used.

The line 76 is connected to the microprocessor-based controller 40 through the multiplexer 64, the analog-to-digital converter 62 and the parallel-to-serial converter 68. Since the resistors $R_A$ through $R_D$ have different resistances, the microprocessor based controller 40, by determining the voltage on the line 76, can in turn determine which of the links A, B, C and D is broken, and thus which of the resistors $R_A$ through $R_D$ are in the circuit. Through a decoding procedure, implemented using conventional techniques, the controller 40 recognizes the required offset.

By way of example, the following TABLE I shows one particular coding scheme which can be implemented:

TABLE I

| Clipped Wire Link | Temperature Adjustment at 375° F. |
|---|---|
| None | 0° F. |
| A | +10° F. |
| B | +20° F. |
| A and B | +30° F. |
| C | −10° F. |
| D | −20° F. |
| C and D | −30° F. |

In the particular coding scheme shown above, it will be seen that a weighted coding sequence is employed. I.e., for example link A has a weight of +10 and link B has a weight of +20. These two links A and B may be broken either individually to yield their individual weights, or both together to yield their combined weight.

The particular coding arrangement is entirely optional, and the four wire links A, B, C and D could be treated such that up to fifteen combination of clipped links yield fifteen discrete, definable adjustments. A service technician, by clipping the wire links in allowable combinations, varies the voltage on the line 76 in discrete, definable steps, allowing the controller 48 to adjust the oven normal cooking temperature, and not affect the self clean temperature. Further, the results are entirely predictable, allowing a desired degree of correction to be immediately effected.

Figure 4:
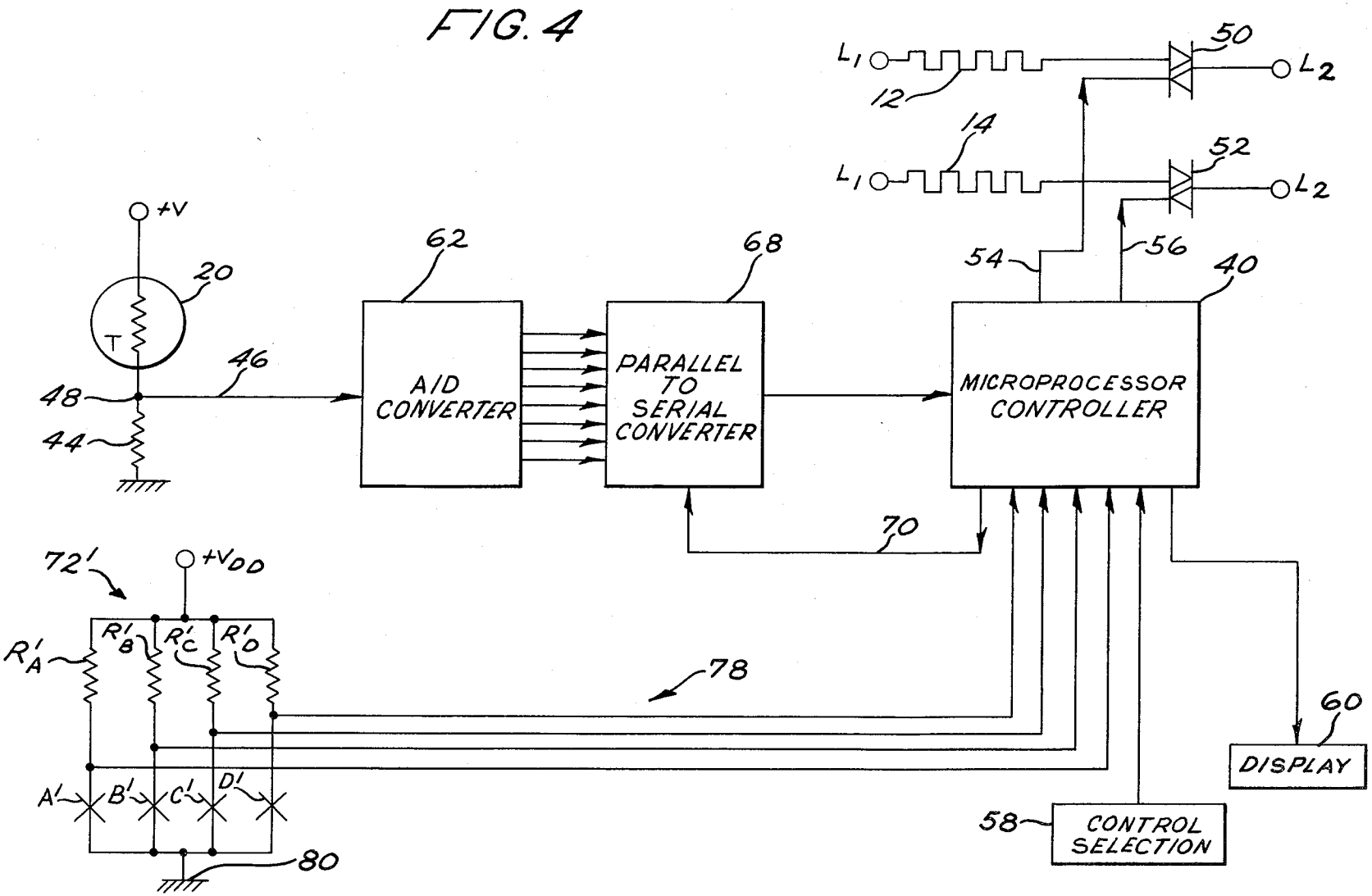
FIG. 4 is an electrical schematic diagram similar to that of FIG. 3, depicting an alternative form of the invention.

Referring next to FIG. 4, an alternative system configuration is illustrated. The system of FIG. 4 differs from that of FIG. 3 primarily in that an alternative form of calibration input device 72' is shown, and directly provides a digital signal along a four-wire bus 78 to the controller 40. The calibration input device 72' of FIG. 4 comprises four pull-up resistors $R_A'$, $R_B'$, $R_C'$ and $R_D'$ connected between the individual lines of the bus 78 and a logic high source $+V_{DD}$. The wire links A', B', C' and D' initially pull all of the lines of the bus 78 low, to a system digital ground point 80. It will be appreciated that the wire links A' through D' comprise a low-cost, reliable and effective form of binary switch, to directly generate a code indicating a particular offset value.

By way of example, a suitable coding sequence for the FIG. 2 arrangement is shown in TABLE II, below:

TABLE II

| Link | Weighting |
|---|---|
| A' | 5° F. |
| B' | 10° F. |
| C' | 20° F. |
| D' | (+) or (−) |

This particular table illustrates a slightly different form of coding, wherein only one of the links (D') indicates the polarity of the offset correction, while the remaining three links (A', B' and C') indicate the amount of the offset. The links A', B' and C' may be broken in any combination to provide any value of offset from 0° F. to ±35° F., in 5° F. increments.

Figure 5:
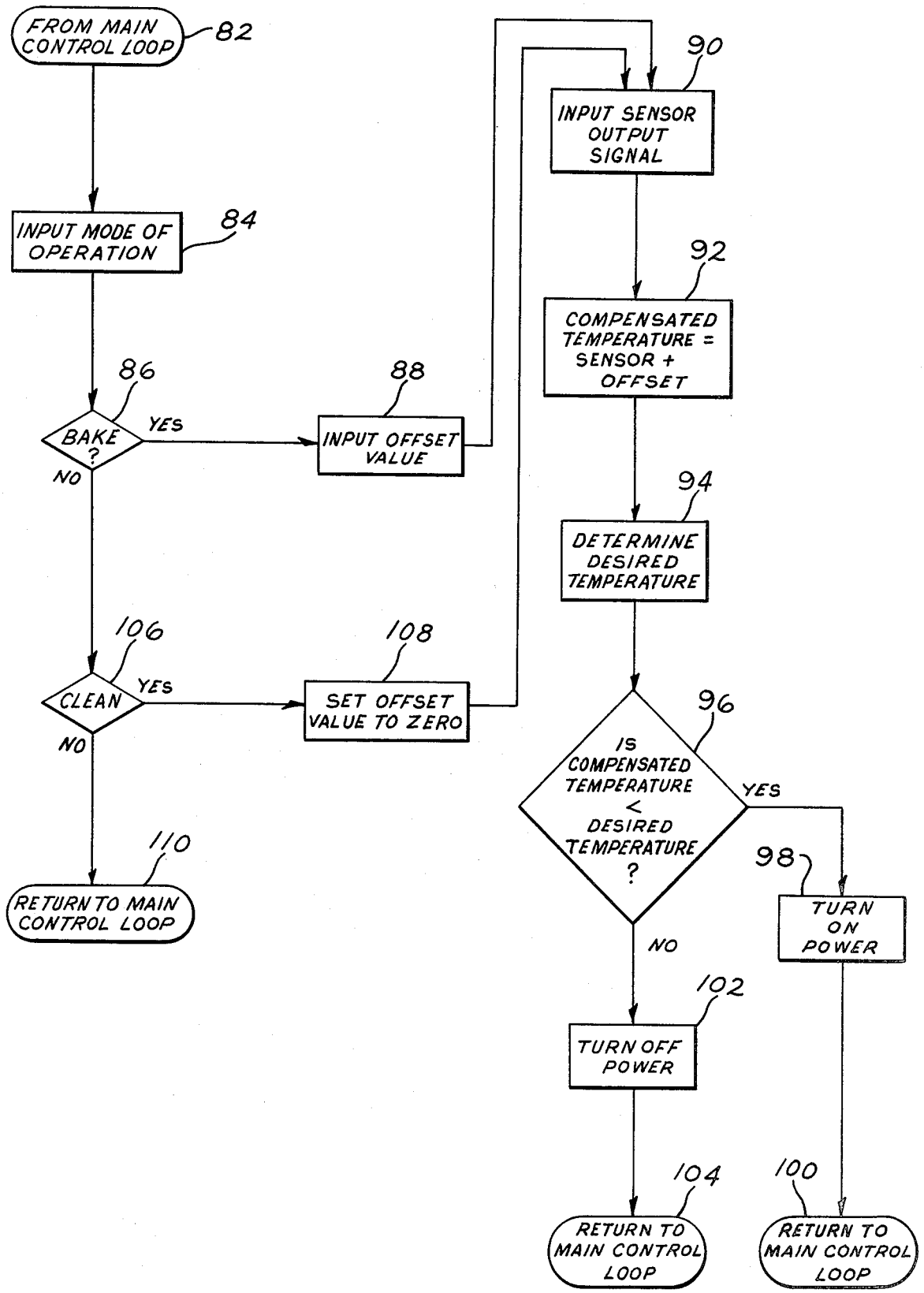
FIG. 5 is a program flowchart depicting one sequence of steps which may be implemented within the microprocessor based controller of either FIG. 3 or FIG. 4 to implement the concepts of the invention.

Referring lastly to FIG. 5, there is shown a generalized flowchart representing one form of program which may be implemented within the microprocessor-based controller 40 of either FIG. 3 or FIG. 4. It will be appreciated that the program of FIG. 5 is only a small part of the overall control program implemented within the controller 40 in view of the other controller 40 functions. In particular, the FIG. 5 flowchart is periodically entered from a main control loop, not otherwise shown, and control returns to the main control loop upon exiting the FIG. 5 program.

The FIG. 5 program is entered at step 82. In step 84, the mode of operation is input, either directly from the control selection 58 or from internal flags (not shown).

Next, in decision step 86, the program determines whether the bake mode is selected, bake mode being one of the normal cooking operations.

If the answer in step 86 is "yes", then in step 88 the offset value from the calibration input device 72 (FIG. 3) or 72' (FIG. 4) is inputted, and suitably decoded in conventional fashion to implement, for example, the scheme depicted in either TABLE I or TABLE II, above.

In the case of the FIG. 3 embodiment, the offset value is inputted by directing the multiplexer 64 to select the line 76, converting to a digital representation in the analog-to-digital converter 62, and inputting this digital representation to the controller 40 which, through a suitable look-up table, determines the desired offset.

In the case of the FIG. 4 embodiment, a digital code is directly input to the controller 40 along the bus 78, the controller 40 then decoding by means of a suitable look-up table.

Next, in step 90, the sensor output signal is inputted. In the FIG. 3 embodiment, this inputting is accomplished by directing the multiplexer 64 to select the input line 46, and the analog voltage from the temperature sensor 20 is then suitably converted to digital form and applied to the controller 48. In the case of the FIG. 4 embodiment, no multiplexer is required.

Next, in step 92, a variable termed "compensated temperature" is calculated by summing the sensor output with the offset value. Next, in step 94, the desired temperature is determined as has been input from the user input device depicted as the control selection 58 in FIGS. 3 and 4.

Next, in step 96, the controller 40 determines, under program control, whether the variable "compensated temperature" is less than the desired temperature. If the answer is "yes", meaning actual oven enclosure 16 temperature is too low, step 98 is entered, wherein the heaters 12 and 14 are energized by gating the triacs 50 and 52. Control then returns to the main control loop at 100.

If on the other hand in step 96 the variable "compensated temperature" is equal to or greater than the desired temperature, the answer is "no", and power to the heating elements 12 and 14 is turned off in step 102, if not otherwise off. Control then returns to the main control loop in step 104.

It will be apparent that the operations performed in steps 92, 94 and 96 can readily be altered to produce the same result by first inputting the desired temperature and adding to the offset, and then comparing the sensor signal with the sum of the desired temperature and the offset value.

In either case, the controller 40 effects the desired control operation to maintain sensor temperature at the desired temperature, properly taking into account the offset value determined by the calibration input device 72 or 72'.

Going back now to step 86 in FIG. 5, in the event self-cleaning mode was selected, the answer in step 86 is "no". At this point, control transfers to step 106 where the program determines whether the oven is in self-cleaning mode. If the answer is "yes", in step 108 the offset value is set equal to zero, and control then jumps to step 90, previously described.

In this event, in step 92, since the offset value is zero, the variable "compensated temperature" is the same as the sensor output. Therefore, the offset as set by the calibration input device 72 or 72' does not affect the self-cleaning temperature calibration in any way.

In step 106, if the answer is "no", meaning neither bake nor self-cleaning mode operation has been selected, the program returns to the main control loop in step 110.

From the foregoing, it will be appreciated that the present invention provides an improved arrangement for calibrating the oven enclosure temperature for normal cooking operations, without affecting adjustment for self-cleaning temperature. The calibration is effected in discrete, definable steps, readily predictable such that subsequent testing to determine the precise effect of the adjustment is not require, thus allowing the field calibration procedure to be relatively fast.

While specific embodiments of the invention have been illustrated and described herein, it is realized that modificatiions and changes will occur to those skilled in the art. It is, therefore, to be understood that the appended claims are intended to cover all such modifications and changes as fall within the true spirit and scope of the invention.

What is claimed is:

1. In an oven having a heating element for heating an oven enclosure, operable in two modes respectively corresponding to two different temperature ranges, and having an oven temperature sensor within the oven enclosure operable in both temperature ranges to provide a sensor output signal, the improvement which comprises:

temperature selection means for enabling the user to select a desired oven temperature setting including a self-cleaning temperature setting;

means responsive to said temperature selection means for establishing a reference temperature signal corresponding to the user selected temperature setting;

a calibration input device for generating a single calibration signal selectively corresponding to one of a plurality of discrete temperature offset values, said device including user operable means for selecting the desired one of said plurality of discrete offset temperature values; and a controller responsive to said temperature sensor, and said calibration input device which operates during one of the modes to energize the heating element as a function of the temperature sensor output signal, the calibrating signal and the reference temperature signal and which operates during the other of the modes to energize the heating element only as a function of the temperature sensor output signal and the temperature reference signal, but not as a function of any calibration signal;

whereby temperature calibration for one of the temperature ranges corresponding to said one of the modes is facilitated without affecting temperature calibration for the other of the temperature ranges corresponding to said other of the modes.

2. An oven according to claim 1, wherein said one of the temperature ranges is a relatively lower range of normal cooking temperatures and said other of the temperature ranges includes a relatively higher pyrolytic self-cleaning temperature.

3. An oven according to claim 1, wherein said calibration input device comprises a discretely adjustable voltage divider including a plurality of series-connected resistors and said user operable setting means comprises a plurality of interruptable wire links, each of said links shunting a different one of said resistors.

4. A method for operating an oven having a heating element and operable in two modes respectively corresponding to two different temperature ranges, and having a temperature sensor within the oven enclosure operable in both temperature ranges to provide a sensor output signal, said method comprising:

selectively generating a reference signal corresponding to one of a plurality of temperature settings including a self-cleaning temperature setting;

selectively generating a single calibration signal corresponding to one of a plurality of discrete temperature offset values;

energizing the heating element as a function of the temperature sensor output signal, the calibration signal corresponding to the desired temperature offset value and the reference signal during operation in one of the modes; and energizing the heating element only as a function of the temperature sensor output signal and the reference signal, but not as a function of any calibration signal, during operation in the other of the modes;

whereby temperature calibration for one of the temperature ranges corresponding to the one of the modes is facilitated without affecting temperature calibration for the other of the temperature ranges corresponding to the other of the modes.

5. An oven according to claim 4, wherein the one of the temperature ranges is a relatively lower range of normal cooking temperatures and the other of the temperature ranges include a relatively higher pyrolytic self-cleaning temperature.

6. An oven according to claim 1, wherein said calibration input device comprises means for generating a digital signal including an output bus comprising a plurality of conductors for coupling said digital signal to said controller and a plurality of parallel-connected resistors, each coupled to said controller by an associated one of said plurality of said output bus conductors and each coupled to a common electrical ground point by an associated interruptable wire link arranged to shunt said associated one of said plurality of output bus conductors.

7. An oven according to claim 2, wherein:

said controller operates during said one of the modes to energize the heating element as required to achieve and maintain the user-desired temperature within the oven enclosure by comparing the sum of the sensor output signal and the calibration signal with the reference temperature signal and energizing the heating element when said sum is less than the reference temperature signal; and said controller operates during said other of the modes to energize the heating element as required to achieve and maintain a pyrolytic self-cleaning temperature within the oven enclosure by comparing the temperature sensor output signal with the reference signal corresponding to the self-cleaning temperature value and energizing the heating element when said sensor output signal is less than said reference signal.

8. In an oven having a heating element for heating an oven enclosure, operable in two modes respectively corresponding to two different temperature ranges, a control arrangement comprising:

an oven temperature sensor disposed within the oven enclosure operative in both temperature ranges to generate a sensor output signal representative of the temperature within the enclosure;

temperature selection means for enabling the user to select a desired oven temperature;

means responsive to said temperature selection means for generating a desired temperature signal representing the desired temperature selected by the user;

calibration means comprising user operative means for enabling the user to select a desired offset temperature value from a plurality of discrete offset temperature values; and means responsive to said user operative means for generating a single offset temperature signal representing the selected offset temperature value;

a controller which operates during one of the modes to energize the heating element as a function of the temperature sensor signal, the offset temperature signal and the desired temperature signal, and which operates in the other mode to energize the heating element only as a function of the temperature sensor signal and the desired temperature signal, but not as a function of an temperature offset signal;

whereby temperature calibration for one of the temperature ranges is facilitated without affecting temperature calibration for the other of the temperature ranges.

* * * * *